US008991639B2

(12) United States Patent
Kells

(10) Patent No.: US 8,991,639 B2
(45) **Date of Patent: *Mar. 31, 2015**

(54) PORTABLE WORK BENCH PAINT TRAY WITH STAIR ADAPTOR

(71) Applicant: Steven R. Kells, North Huntington, PA (US)

(72) Inventor: Steven R. Kells, North Huntington, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/102,572

(22) Filed: Dec. 11, 2013

(65) Prior Publication Data

US 2014/0097190 A1 Apr. 10, 2014

Related U.S. Application Data

(63) Continuation-in-part of application No. 13/541,952, filed on Jul. 5, 2012, now Pat. No. 8,657,144.

(51) Int. Cl.
*B65D 1/36* (2006.01)
*B44D 3/12* (2006.01)
*B44D 3/14* (2006.01)

(52) U.S. Cl.
CPC *B65D 1/36* (2013.01); *B44D 3/125* (2013.01); *B44D 3/126* (2013.01); *B44D 3/14* (2013.01)
USPC ..... 220/570; 220/630

(58) Field of Classification Search
CPC ..... B65D 1/36; B65D 25/24; B44D 3/125; B44D 3/126; B44D 3/14
USPC ..... 220/629, 630, 636, 570, 628; 248/688, 248/148, 149, 151, 127, 128, 213.2, 110, 248/111; 403/375, 381, 331; 108/157.1, 108/157.15, 157.16, 158.12
See application file for complete search history.

(56) References Cited

U.S. PATENT DOCUMENTS

| | | | | |
|---|---|---|---|---|
| 80,289 | A * | 7/1868 | Leavitt | 108/158.12 |
| 4,102,468 | A | 7/1978 | Goldman | |
| D303,467 | S | 9/1989 | Pepitone | |
| 4,889,254 | A | 12/1989 | Vola | |
| 5,217,193 | A | 6/1993 | Drucker | |
| 5,240,214 | A | 8/1993 | Birnbaum | |
| 5,249,397 | A * | 10/1993 | Monaco | 52/126.1 |
| 5,624,093 | A | 4/1997 | Gemmell | |
| 5,746,345 | A | 5/1998 | Zurawin | |
| 5,785,003 | A | 7/1998 | Jacobson et al. | |
| 5,820,091 | A | 10/1998 | Kutscher | |
| 5,875,912 | A * | 3/1999 | Hobson | 220/4.03 |
| 5,913,782 | A * | 6/1999 | Monaco et al. | 52/126.1 |
| 6,543,680 | B1 | 4/2003 | McCormack | |
| 6,543,733 | B1 * | 4/2003 | Pennington | 248/149 |
| D548,417 | S | 8/2007 | Kohn | |

(Continued)

*Primary Examiner* — Fenn Mathew
*Assistant Examiner* — Robert Stodola
(74) *Attorney, Agent, or Firm* — McKay & Associates, P.C.

(57) ABSTRACT

A tray held by a stair adaptor for securing the tray either on a stairwell or on a work bench. A first slidable arm and a second slidable arm each have an adaptor leg extending downward therefrom, wherein the first adaptor leg and the second adaptor leg are sized to be accommodated within a pair of parallel clamping members of a workbench. The first slidable arm and the second slidable arm include a mating member upstanding therefrom, the mating member shaped substantially similar to a shape of each of the slots on an underside of a tray body and configured to slidably engage with at least one of the slots, wherein the first slidable arm penetrates the right side of the stair adaptor and the second slidable arm penetrates the left side of the stair adaptor to level and secure the tray body on a stairway or workbench.

10 Claims, 6 Drawing Sheets

(56) References Cited

U.S. PATENT DOCUMENTS

| | | | |
|---|---|---|---|
| 7,527,164 | B1 | 5/2009 | Reichborn |
| 2006/0064843 | A1 | 3/2006 | Cornelissen |
| 2007/0163974 | A1 | 7/2007 | Lai |
| 2008/0029520 | A1 | 2/2008 | Hucks |
| 2008/0127443 | A1 | 6/2008 | Blanchard |
| 2009/0173849 | A1 | 7/2009 | Rose et al. |

* cited by examiner

PORTABLE WORK BENCH PAINT TRAY WITH STAIR ADAPTOR

CROSS-REFERENCE TO RELATED APPLICATIONS

The instant application is a continuation-in-part of application Ser. No. 13/541,952 filed Jul. 5, 2012, now U.S. Pat. No. 8,657,144, which claimed benefit of provisional application Ser. No. 61/521,427 filed Aug. 9, 2011, the disclosures of both of which are herein incorporated by reference.

BACKGROUND

1. Field of the Invention

The instant invention relates to organizational trays. In particular, described is a tray for holding paint and utensils.

2. Description of the Related Art

Various tools and brushes for exterior and interior painting are obviously known in the art. So too are different types of trays and roller pans for containing and rendering easily-accessible the paint used for the project, as well as the brushes, cans, and rollers. For instance U.S. Pat. No. D303,467 shows a paint tray having a recess for holding a paint can. The tray itself is recessed to hold various painting tools. U.S. Pat. No. D548,417 to Kohn shows a similar recess within a paint tray, further including a recess defined within the tray for holding a roller. FIG. 1 of U.S. Pat. No. 5,746,345 also shows a paint brush recess within a rolling tray.

Standard also are workbenches, designed typically as flat, sturdy tables. Design may be varied according to their inclusion of means for fixing workpieces, means for storing tools, or by including features which allow the bench's height to be varied, among others. Workbenches are also commonly used by painters to hold or support the aforementioned trays, cans, and brushes.

Furthermore, different types of trays perform various functions and are adapted to be used at various locations. U.S. Patent Publication 2009/0173849 to Rose et al. teaches a holder for a paint container which can be used on uneven surfaces. The holder includes a base and at least one leg selectively positionable for fixing the angle of the leg. U.S. Pat. No. 5,217,193 to Drucker relates to a paint can holder for use on an angled roof There is a need then for a tray which can be used at alternative locations such as within a stairwell or on a staircase and but which is still compatible with typical painting and repair equipment.

SUMMARY

It is the objective of the instant invention to provide a paint tray which is compatible with various workbenches.

It is further the objective to provide a paint tray which can be used within a stairwell or on unlevel stair surfaces.

It is further an objective of the instant invention to provide a paint tray which is multi-functional.

Accordingly, comprehended is a tray, comprising a tray body having a front, a back, a right side, a left side, and an underside of the tray body. A stair adaptor further comprises a first slidable arm and a second slidable arm; a first adaptor leg extending downward from the first slidable arm, and a second adaptor leg extending downward from the second slidable arm, wherein the first adaptor leg and the second adaptor leg are sized to be accommodated within a pair of parallel clamping members of a workbench. The first slidable arm and the second slidable arm include a mating member upstanding therefrom, the mating member shaped substantially similar to a shape of each of the slots and configured to slidably engage with at least one of the slots on the underside, wherein the first slidable arm penetrates the right side of the stair adaptor and the second slidable arm penetrates the left side of the stair adaptor to level and secure the tray body on a stairway or workbench. Multiple slots include a pair of front slots proximate to the front and a pair of central slots central to the tray body, wherein upon placement of the tray body on an upper step of the stairway the stair adaptor engages only the front slots and levels the tray while the adaptor base rests on an adjacent lower step, and wherein upon placement of the tray body on the workbench the stair adaptor engages only the central slots to prohibit the tray body from sliding off the workbench.

DETAILED DESCRIPTION OF THE PREFERRED EMBODIMENT

Figure 1:
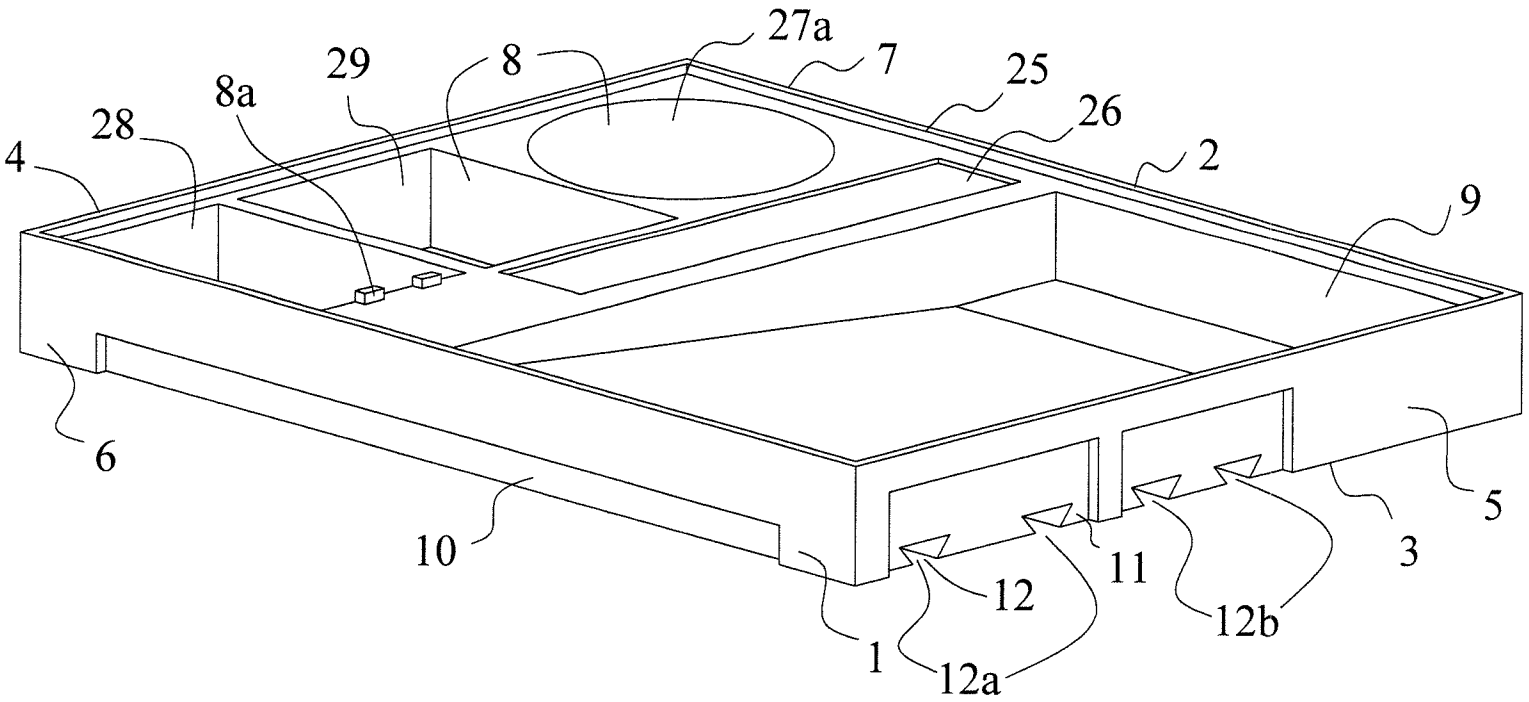
FIG. 1 shows a perspective view of the instant tray.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention. "A" or "an" as used in the disclosure and claims may mean one or more.

With reference then to FIGS. 1-5, shown is the instant tray. Tray has a tray body 1, an outer perimeter 2, an underside 3, a left side 4, a right side 5, a front 6, and a back 7. Although the overall shape of the tray body 1 may vary, it preferably is formed generally as a rectangle in the preferred embodiment since it is well-suited to be situated on workbenches, as further described. A disposable tray liner 24 can be used which will conform to the shape of the tray body 1.

Traveling around the outer perimeter 2 is raised edge 25. Raised edge 25 is raised to upstand vertically around the edge so as to contain paint drips and spills.

Tray body 1 includes multiple recesses, which are preferably indentations defined downward into tray from its top, hereinafter defined collectively as "utility recesses 8". Each utility recess 8 is defined within the tray body 1 and performs various functions. For one, defined within tray body 1 is a paint stirrer recess 26 formed as a shallow pocket wherein a wooden paint stirrer or similar can be situated. Paint stirrer recess 26 as shown is generally rectangular to conform or be similar to the typical size and shape of a paint stirrer. Another utility recess 8 is the paint can recess 27*a*, generally circular to contain a container such as a paint can. A paint brush recess 28 is further defined within tray body 1 to, in one embodiment, hold a paint brush, but it can be used to secure any article if need be. Of note is that a brush grip 8*a* is formed adjacent to the top edge of the paint brush recess 28. The brush grip 8*a* preferably includes a pair of opposing, raised tabs which are spaced to define a slot which can be used to contain the small handle affiliated with a paint brush. In this manner the brush end resides over the paint brush recess 28 to contain any drips. A trim tray recess 29 is also defined within the tray body 1, which can contain small amounts of paint and is typically the larger recess relative to the paint brush recess 28. Lastly, a roller tray 9 is defined within the tray body 1, optionally angling downward from the front 6 to the back 7, enabling the tray to be used with a roller.

Now to the front 6 of the tray body 1 with continued reference to FIGS. 1-4, defined therein is a front cut-out 10. Although not shown, an additional and identical cut-out is provided on the back 7 of the tray. Each cut-out 10 travels most of the length of the tray body 1 but not quite up to the raised edge 25 of tray body 1. Front cut-out 10 is the area in which work bench swivel pegs 23 may abut, as will be further described with reference to FIG. 3.

A pair of side cut-outs 11 is defined within the right side 5 of tray body 1, which will aid in the implementation of the stair adaptor 13, namely serving as the receiver for the locking bar 19. An additional pair of matching side cut-outs (not shown) can reside within the left side 4 of tray body 1. Further in conjunction with the stair adaptor 13, one or more a slots 12 is defined in the underside 3 of the tray body 1 traveling the entire length of the tray body 1. More specifically, defined in the underside 3, a pair of front slots 12*a* are proximate to the front 6 and a pair of central slots 12*b* are defined central to the tray body 1. The front slots 12*a* terminate at one of the side cut-outs and the central slots terminate at the other of the side cut-outs 11. As shown, each slot 12 in cross-section is generally of an inverted trapezoid shape but may vary depending on the shape of the stair adaptor 13, as further described.

Figure 2:
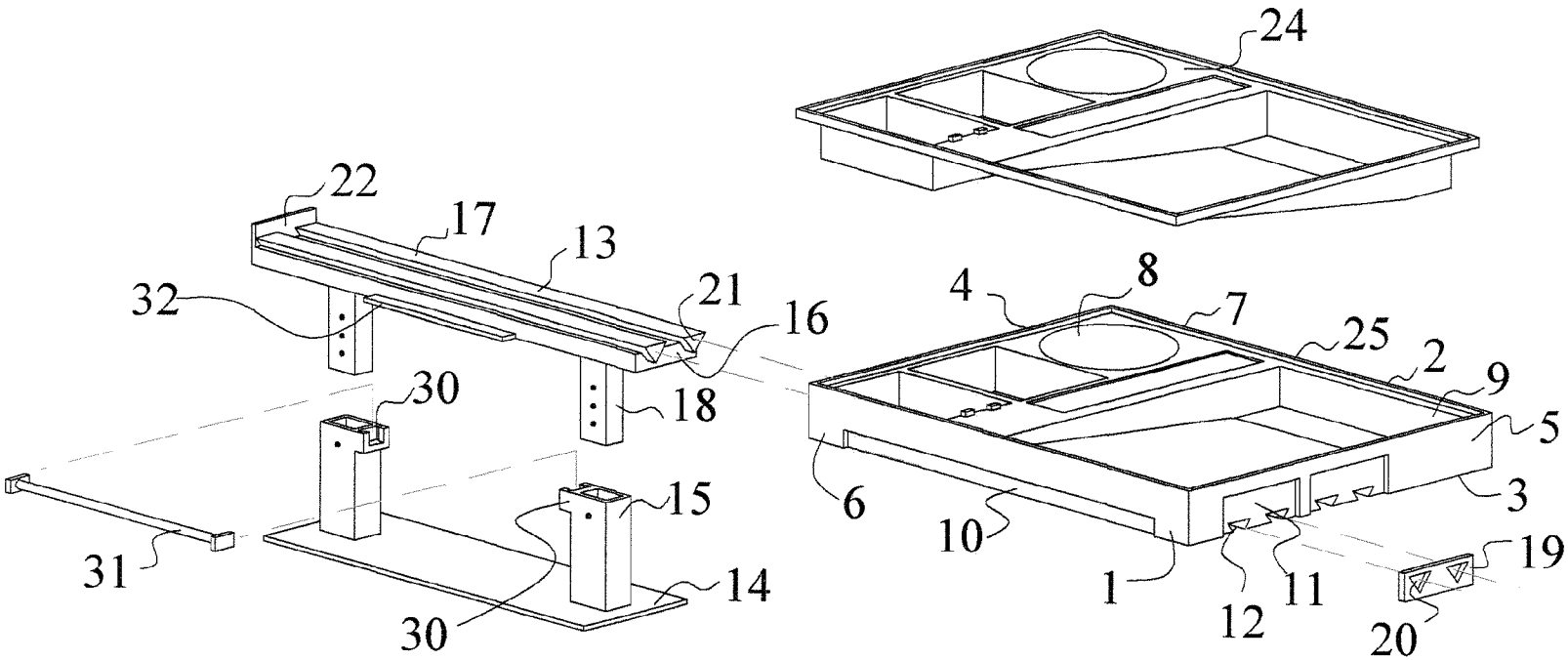
FIG. 2 shows an exploded perspective view of the instant tray along with the system's additional components.

FIG. 2 details the stair adaptor 13 for use in conjunction with the tray body 1. The stair adaptor 13 includes a base 14, which is a flat platform dimensioned to fit a stair. A pair of tubular leg seats 15 upstand perpendicularly from the base 14. An adaptor surface 16 longitudinal in nature forms the support for a variety of components. Namely, a mating member 17 is integrally attached to the adaptor surface 16, the mating member 17 shaped substantially similar to a shape of the slot 12 on the underside 3 of the tray body 1. "Substantially similar" in this context means the shape of the mating member 17 is identical to the shape of the slot 12 but for the portion of the mating member that would not reside in the slot and the slight dimensional variance of the mating member 17 to allow the mating member 17 to fit within the slot 12. The mating member 17 therefore is configured to slidably engage with a respective one of the slots 12 on the underside 3. Then a pair of adaptor legs 18 extends downward from the adaptor surface 16. The adaptor legs 18 are configured to be received within the tubular leg seats 15 and be temporarily fixed into position using any type of pin such as a cotter pin. As a result, upon placement of one half of the tray body 1 on an upper step of a stairway, the stair adaptor 13 while engaged to and supporting the other half of the tray body 1, levels the tray body 1 while the adaptor base 14 rests on an adjacent lower step (see FIG. 5). "One-half" as herein defined means the underside 3 of the tray body 1 which extends away from the center most slot. The other half would therefore be the opposing half which includes the slots 12.

A locking bar 19 is shaped with defined female hollow portions 20 to engage an end 21 of the mating member 17. In this manner, upon engagement by the female hollow portion 20 member by friction to the mating member 17, the stair adaptor 13 can be temporarily locked in place to secure the stair adaptor 13 underneath the tray body 1 as raised stopping edge 22 of adaptor surface 16 abuts the opposite side of tray body 1, namely disposed within the opposing cut-outs which mirror the side cut-outs 11 but on the left side 4 as mentioned above. Shown herein the locking bar 19 is a rectangular plate, but this shape may vary as long as it conforms to the side cut-out 11 because the locking bar 19 embeds itself into the side cut-out 11. The shape of female hollow portion 20 may also vary but match the shape of each end 21 of the mating member 17.

Figure 5:
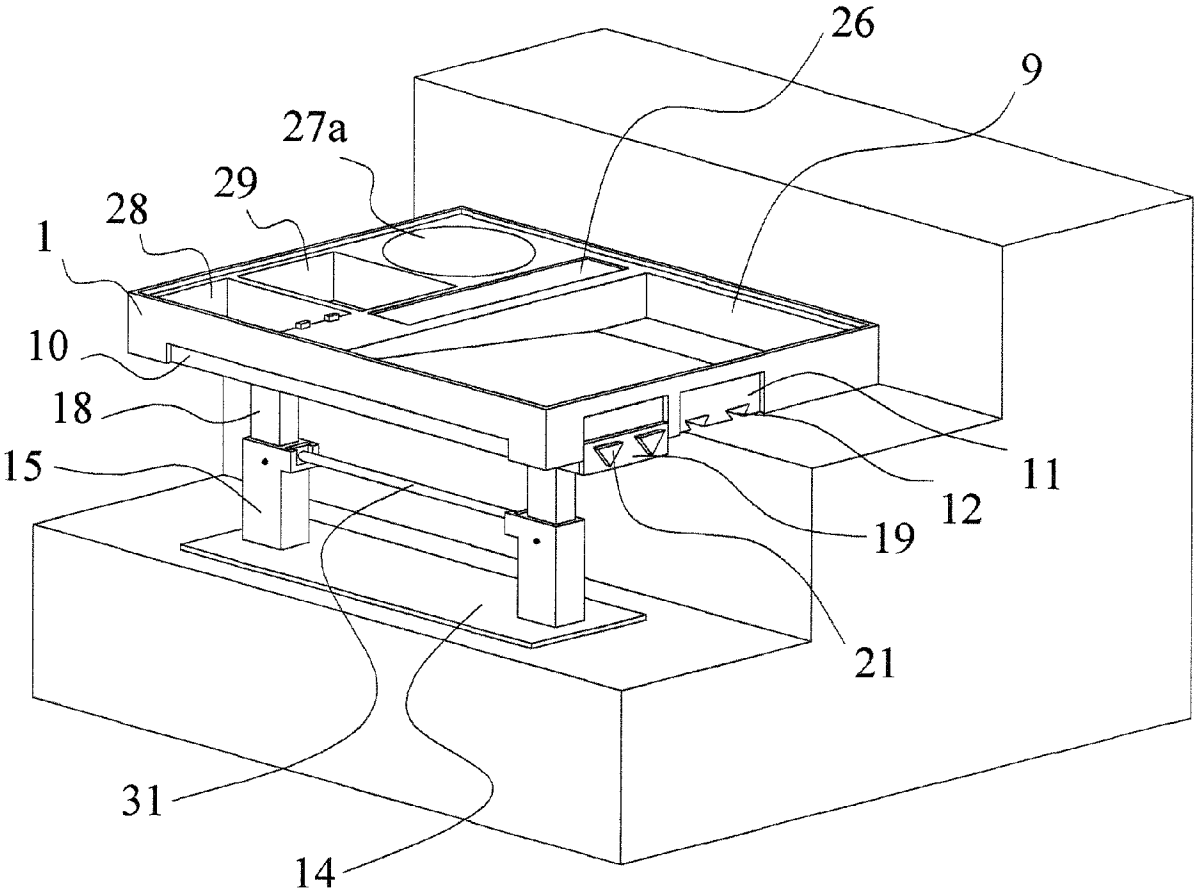
FIG. 5 shows a perspective view of the instant tray in use along a staircase.

As an additional feature and with further reference to FIGS. 2 and 5, each adaptor leg 18 has formed integrally thereto an adaptor seat 30 formed as an extension at the top thereto. Each adaptor seat 30 has defined therein a cavity. A dowel rod 31 having two ends can therefore rest on the adaptor legs 18 spanning the distance between the adaptor legs 18 as each end sits within each respective cavity. As a result the dowel rod 31 can be used to hold towels, paper towels, or other similar draping articles.

Figure 3:
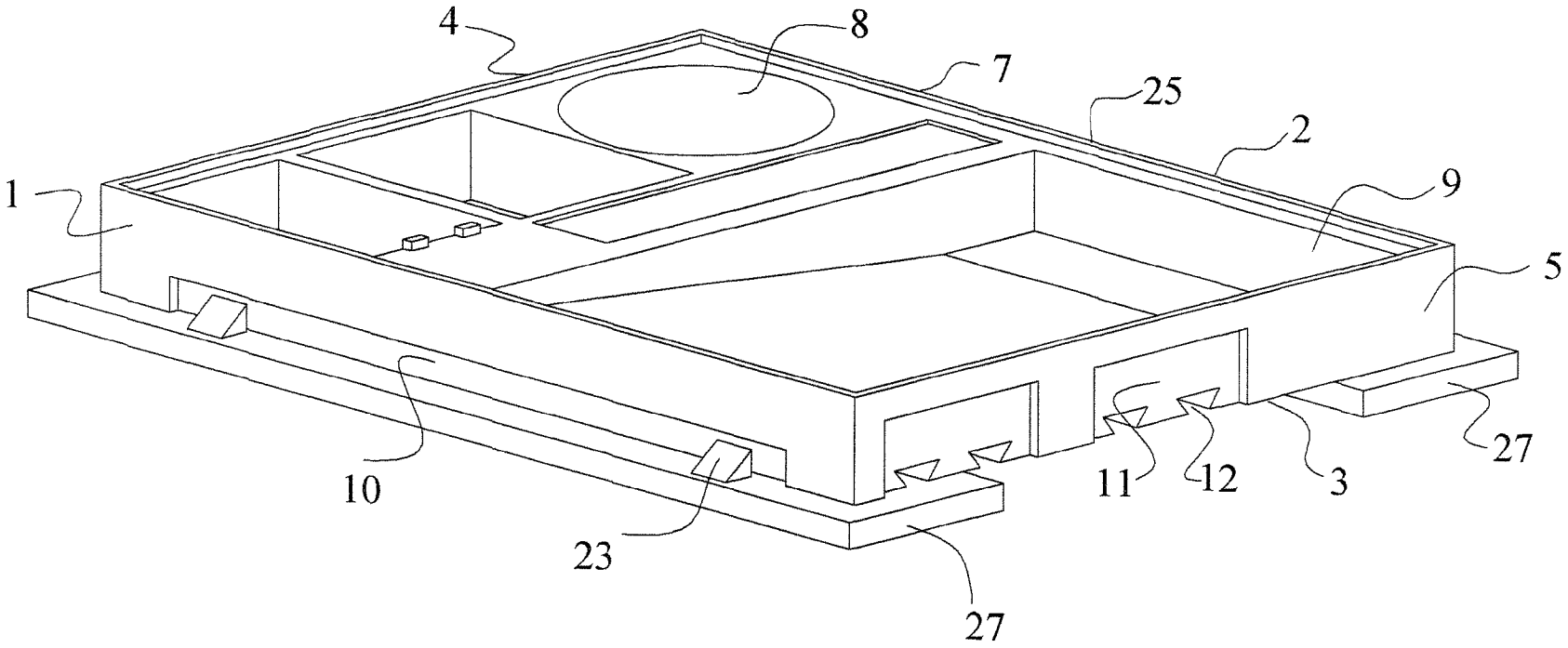
FIG. 3 shows a perspective view of the instant tray in use on a workbench surface.
Figure 4:
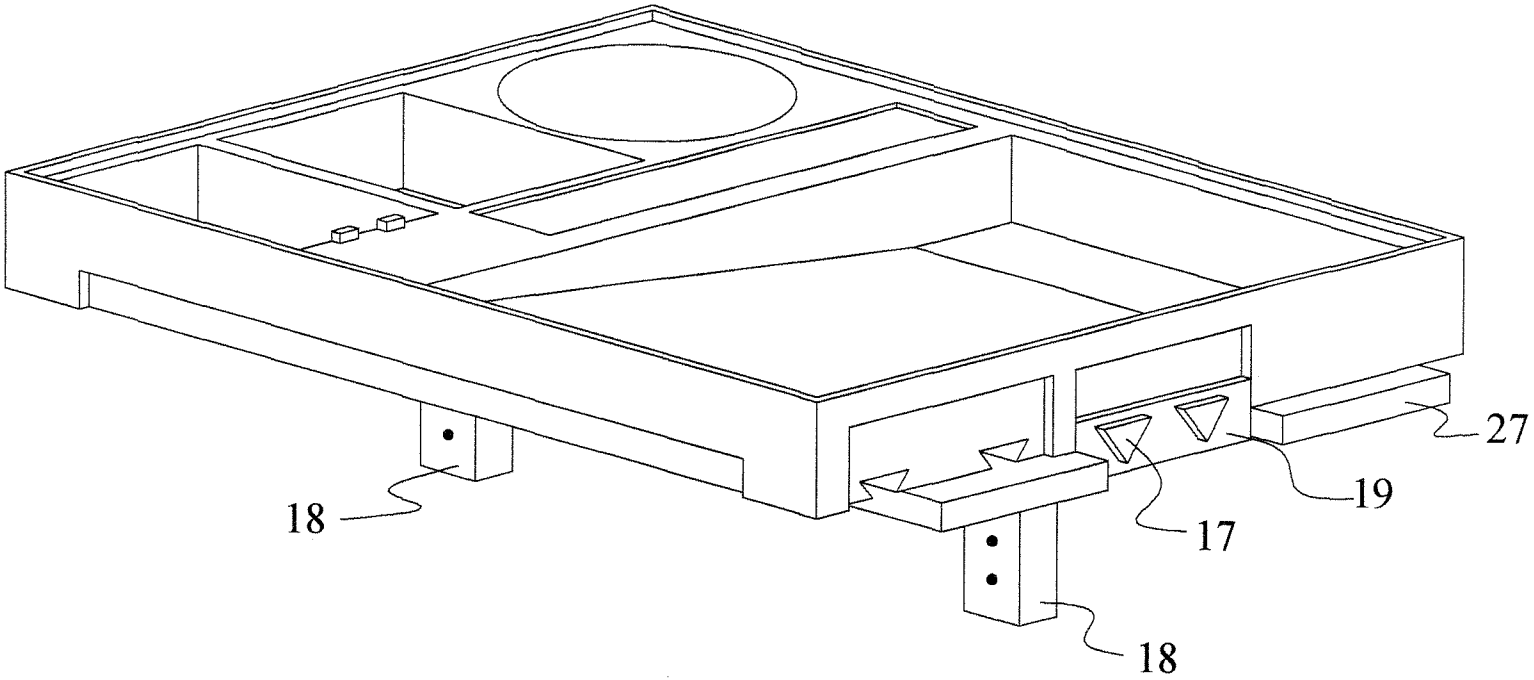
FIG. 4 shows another perspective view of the tray on a workbench with the stair adaptor aiding in its placement.

With particular reference to FIGS. 3 and 4, the tray body 1 is especially suited to be situated on a workbench 27 as desired. This is allowed by way of the flat underside 3, the stair adaptor 13, and/or the rear and front cut-out 10. Each cut-out 10 is adapted to have abutted therein one or more swivels pegs 23. As known, swivel pegs 23 are interchangeable projections which can be inserted into the workbench 27. As such the dimensions of the workbench 27 are changed and therefore the instant tray can be located on the workbench 27 without sliding of its surface.

In the embodiment above, the slots 12 which are most proximate to the front 6 would typically be used when the tray is in use on a stair (see FIG. 2) using the stair adaptor 13. However, the stair adaptor 13 is also used in conjunction with a workbench 27 having small dimensions by utilizing the slots 12 which are most central to the tray body 1. Some smaller work benches do not open wide enough for an object to fit between the swivel pegs 23. FIG. 4 shows the stair adaptor 13 (hidden from view) engaged with its mating members 17 to the underside 3 of the tray body 1 with its adaptor legs 18 disposed downward. In this manner the stair adaptor 13 provides a securement mechanism for the tray to be used on a workbench 27 where the workbench here is very narrow. Although the tray body 1 overhangs the small workbench 27, the tray body 1 is made more secure on the surface of the workbench 27 because the stair adaptor 13 with its adaptor legs 18 prohibit the sliding of the tray body 1 as the stair adaptor 13 and adaptor legs 18 reside within and through the parallel clamping boards of the workbench 27. Furthermore, stair adaptor 13 includes lower lip 32 formed as an oblong flange on the front and back (not shown) of the adaptor surface 16. When the stair adaptor 13 is used to secure the tray body 1 on the workbench 27, the lower lip 32 will abut against the underside of the parallel clamping board of the workbench 27, thus preventing the tray body 1 from tilting or being lifted out of the workbench 27. Thus, the stair adaptor 13 provides two functions, namely stability on a stairwell (see FIG. 5) and stability on small workbench surfaces (see FIGS. 3 and 4).

Figure 7:
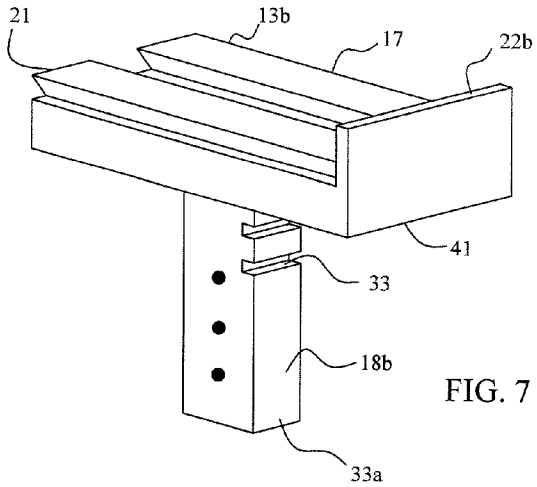
FIG. 7 shows a perspective view of the other side of the alternative embodiment of the stair adaptor.
Figure 6:
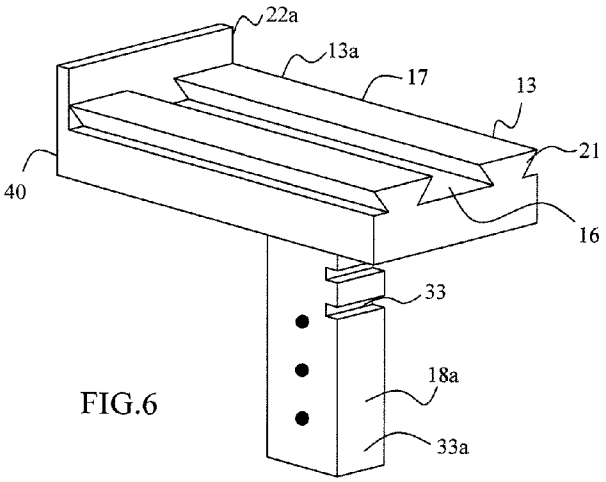
FIG. 6 shows a perspective view of one side of an alternative embodiment of the stair adaptor.
Figure 8:
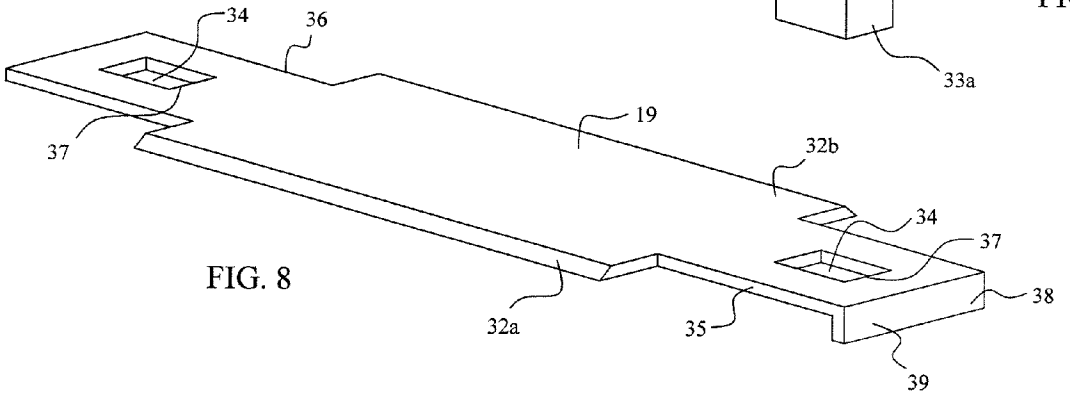
FIG. 8 shows a perspective view of an alternative embodiment of the locking arm used with the alternative stair adaptor two-leg configuration.

Referencing now FIGS. 6-8, shown is an alternative embodiment of the stair adaptor 13 also with alternative locking bar 19. The tray with tray body 1 (FIGS. 1-5) used with this embodiment of the stair adaptor 13 is generally the same, along with all tray recesses and features, as is the base 14 with tubular leg seats 15. But here, the stair adaptor 13 is formed of two components, namely a first slidable arm 13*a* and a second slidable arm 13*b* which are adapted to "sandwich" together into the tray body 1, as follows.

A first adaptor leg 18*a* extends downward from the first slidable arm 13*a*, and a second adaptor leg 18*b*, identical to the first adaptor leg 18*a*, extends downward from the second slidable arm 13*b*. So here, much like the above, the first adaptor leg 18*a* and the second adaptor leg 18*b* are sized to be accommodated within a pair of parallel clamping members of a workbench, but a critical difference being the stair adaptor 13 in this embodiment is generally a two-piece system.

The first slidable arm 13*a* and the second slidable arm 13*b* each include the same mating members 17 upstanding therefrom, the mating members 17 shaped substantially similar to a shape of the slot of the tray underside and configured to slidably engage with at least one of the slots on the underside of the tray (as above). But here, different from the above, the first slidable arm 13*a* penetrates one side of the tray body and the second slidable arm 13*b* penetrates an opposing side of the tray body to level and secure the tray body on a stairway or workbench. The slots additionally do not need to travel the entire underside of the tray if desired.

In the instant embodiment, the first slidable arm 13*a* comprises a first stopping edge 22*a* upstanding from a first outermost end 40 and the second slidable arm 13*b* comprises a second stopping edge 22*b* upstanding from the second outermost end 41, wherein each side-cut out (11 of FIGS. 2 and 3) of the tray is shaped to receive the first stopping edge 22*a* or the second stopping edge 22*b*.

In the instant alternative embodiment and with continued reference to FIGS. 6-8, the means for securing the tray using the locking bar 19 also takes an alternative form. The locking bar 19 here comprises a locking bar front 35, a locking bar rear 36, two locking bar ends 39, and a pair of leg holes 34, each leg hole 34 defined through the locking bar 19 proximate to each locking bar end 39 such that the locking bar 19 can be slid up and over the first adaptor leg 18*a* and the second adaptor leg 18*b* to secure the first slidable arm 13*a* and the second slidable arm 13*b* by prohibiting its laterally movement when in place. To "further" secure the stair adaptor 13, i.e. additional securement other than by the prohibited movement resulting from the locking bar 19 itself being engaged to the legs 18*a*, 18*b*, the first adaptor leg 18*a* and the second adaptor leg 18*b* have defined therein at least one groove 33 on one leg side 33*a* thereof. Each leg hole 34 has a leg hole edge 37 for engaging a respective one of the grooves 33 of the first adaptor leg 18*a* and the second adaptor leg 18*b* as shown such that now the locking bar 19 can be slid over the first adaptor leg 18*a* and the second adaptor leg 18*b* and pushed laterally into the grooves 33 to further secure and essentially lock the first slidable arm 13*a* and the second slidable arm 13*b*. A handle 38 attached to the locking bar 19 at one of the locking bar ends 39 as shown is included to aid in this lateral pushing force.

In the preferred embodiment there is more than one groove 33 on each leg side 33*a* because different makes of workbenches have different thicknesses. Accordingly, a lower of set of grooves 33 might be utilized with a thicker workbench, whereas an uppermost of the grooves 33 would be used in the instance the tray is to be locked on a thinner workbench. Thus, a tight securement results even when the stair adaptor 13 with tray is used on a variety of workbenches.

Additionally, in the instant embodiment, the locking bar 19 has a front lower lip 32*a* projecting from the locking bar front 35 and rear lower lip 32*b* projecting from the locking bar rear 36, "projecting" meaning planar relative to all surfaces of the locking bar 19 but extending outward as shown from the locking bar front 35 and locking bar rear 36, parallel thereto. In this instance the projecting lips 32*a*, 32*b* provide additional surface area for the engagement with the underside of the workbench or stair adaptor 13 (when used on a stairway) and thus more stability.

I claim:

1. A tray, comprising:

a tray body having a front, a back, a right side, a left side, and an underside;

multiple slots defined within said underside of said tray body, wherein said multiple slots include a pair of front slots proximate to said front and a pair of central slots central to said tray body, wherein upon placement of said tray body on an upper step of a stairway said stair adaptor engages only said front slots and levels said tray while said adaptor base rests on an adjacent lower step, and wherein upon placement of said tray body on a workbench said stair adaptor engages only said central slots to prohibit said tray body from sliding off said workbench;

a stair adaptor, further comprising:

a first slidable arm and a second slidable arm;

a first adaptor leg extending downward from said first slidable arm, and a second adaptor leg extending downward from said second slidable arm, wherein each said first adaptor leg and said second adaptor leg are sized to be accommodated within a pair of parallel clamping members of a workbench;

each said first slidable arm and said second slidable arm including a mating member upstanding therefrom, said mating member shaped substantially similar to a shape of each of said slots and configured to slidably engage with at least one of the slots on said underside, wherein said first slidable arm penetrates said right side of said tray body and said second slidable arm penetrates said left side of said tray body to level and secure said tray body on a stairway or workbench.

2. The tray of claim 1, wherein said first slidable arm comprises a first stopping edge upstanding from a first outermost end and said second slidable arm comprises a second stopping edge upstanding from said second outermost end.

3. The tray of claim 1, wherein each said first adaptor leg and said second adaptor leg have defined therein at least one groove on one leg side thereof.

4. The tray of claim 1, further comprising a locking bar having a locking bar front, a locking bar rear, two locking bar ends and a pair of leg holes, each said leg hole defined through said locking bar proximate to each said locking bar end such that said locking bar can be slid over said first adaptor leg and said second adaptor leg to secure said first slidable arm and said second slidable arm.

5. The tray of claim 4, further comprising a handle attached to said locking bar at one of said locking bar ends.

6. The tray of claim 4, wherein each said leg hole has a leg hole edge for engaging a respective one of said grooves of said first adaptor leg and said second adaptor leg such that said locking bar can be slid over said first adaptor leg and said second adaptor leg and pushed laterally into said grooves to further secure said first slidable arm and said second slidable arm.

7. The tray of claim 4, wherein said locking bar has a front lower lip projecting from said locking bar front and rear lower lip projecting from said locking bar rear.

8. The tray of claim 1, further comprising at least one utility recess defined within said tray body; a roller tray defined within said tray body traveling from said front to said back; a front cut-out defined along said front; and multiple side cut-outs.

9. The tray of claim 8, wherein one of said side cut-outs is defined within said right side of said tray body and another of said side-cut outs is defined within said left side of said tray body.

10. The tray of claim 1, wherein said stair adaptor further comprises a base; a pair of tubular leg seats upstanding from said base; and wherein each said first adaptor leg and said second adaptor leg is configured to be received within each said tubular leg seat.

* * * * *